US008047134B2

(12) United States Patent
Hoffmann et al.

(10) Patent No.: US 8,047,134 B2
(45) Date of Patent: Nov. 1, 2011

(54) RUBBER SLEEVE

(75) Inventors: Eduard Hoffmann, Bobingen (DE); Thomas Kandlbinder, Augsburg (DE); Christian Sameit, Bonstetten (DE); Georg Schmid, Neusaess (DE)

(73) Assignee: manroland AG, Offenbach/Main (DE)

( * ) Notice: Subject to any disclaimer, the term of this patent is extended or adjusted under 35 U.S.C. 154(b) by 599 days.

(21) Appl. No.: 12/244,279

(22) Filed: Oct. 2, 2008

(65) Prior Publication Data

US 2009/0095180 A1 Apr. 16, 2009

(30) Foreign Application Priority Data

Oct. 2, 2007 (DE) ..... 10 2007 047 172

(51) Int. Cl.
*B41F 13/08* (2006.01)

(52) U.S. Cl. ..... 101/376; 101/217; 101/401.1; 101/493

(58) Field of Classification Search ..... 101/376
See application file for complete search history.

(56) References Cited

U.S. PATENT DOCUMENTS 4,515,375 A * 5/1985 Bleckmann et al. ..... 101/415.1
4,742,769 A * 5/1988 Zeller ..... 101/375
5,125,337 A * 6/1992 Zeller ..... 101/415.1
5,316,798 A 5/1994 Tittgemeyer
5,351,615 A 10/1994 Koebler et al.
5,379,693 A * 1/1995 Hoffmann et al. ..... 101/375
5,749,298 A 5/1998 Castelli et al.
6,371,023 B1 * 4/2002 Francille ..... 101/375
6,484,632 B2 11/2002 Hoffmann et al.
6,782,820 B1 8/2004 Okubo et al.
6,848,364 B1 * 2/2005 Byers et al. ..... 101/376

FOREIGN PATENT DOCUMENTS

DE 33 15 506 A1 10/1984
DE 43 20 464 A1 12/1994
FR 2 591 943 A1 6/1987

OTHER PUBLICATIONS

German Search Report, dated Feb. 18, 2011, 5 pages.
European Search Report, Jun. 2, 2009.

* cited by examiner

*Primary Examiner* — Jill Culler
(74) *Attorney, Agent, or Firm* — Crowell & Moring LLP

(57) ABSTRACT

A rubber sleeve for a printing press and a method for producing a rubber sleeve is disclosed. The rubber sleeve has a rigid support sleeve and a blanket that is wrapped around the support sleeve as well as is firmly connected to the support sleeve. The blanket has at least a two-layer structure with an inner layer embodied as a base layer and an outer layer serving as a functional layer for the printing process, where the butting edges of the blanket are connected to one another via a sealing material, which is introduced in a gap embodied between the butting edges. The sealing material is introduced in the gap embodied between the butting edges while forming a channel.

6 Claims, 1 Drawing Sheet

RUBBER SLEEVE

This application claims the priority of German Patent Document No. 10 2007 047 172.8, filed Oct. 2, 2007, the disclosure of which is expressly incorporated by reference herein.

BACKGROUND AND SUMMARY OF THE INVENTION

The invention relates to a rubber sleeve for a printing press. In addition, the invention relates to a method for producing a rubber sleeve for a printing press.

In principle, two methods for producing a rubber sleeve for a printing press are known from practice.

According to a first method for producing a rubber sleeve known from practice, such as, for example, from U.S. Pat. No. 5,316,798, a rigid support sleeve made of metal or a composite material and which is closed or continuous in the circumferential direction is made available, wherein additional continuous layers of the rubber sleeve are applied successively to this support sleeve. This is accomplished preferably in a so-called coating method.

According to a second method for producing a rubber sleeve known from practice, such as, for example, described in U.S. Pat. Nos. 5,351,615 and 6,484,632, a rigid support sleeve made of metal or a composite material and which is closed or continuous in the circumferential direction and in addition a blanket with at least a two-layer structure as a semi-finished product are also made available, wherein a pre-cut part of the blanket is wrapped around the rigid support sleeve and firmly connected to the rigid support sleeve. In the process, butting edges of the blanket must be connected to each other in order to prevent the penetration of solutions and/or ink, wherein, for this purpose, according to the prior art, a sealing material is introduced flush with the surface of the blanket in an air gap embodied between the butting edges, and wherein the blanket and the sealing material are finished by grinding. However, the region of the sealing material continues to represent, in terms of printing, a malfunction location or an interruption so that continuous printing is not possible there. These types of rubber sleeves have a limited service life because they are not sufficiently able to absorb the stresses occurring in operation.

Starting herefrom, the present invention is based on the objective of creating a novel rubber sleeve as well as a novel method for producing the same.

According to the invention, the sealing material is introduced in the air gap embodied between the butting edges while forming a channel. The channel also forms an air gap in the process, which essentially interrupts the outer printing layer at least partially, and as the case may be also the inner layers.

The fact that, in the case of the inventive rubber sleeve, the sealing material is introduced in the air gap embodied between the butting edges of the pre-cut blanket part while forming a channel, which allows a considerably longer service life to be realized for a rubber sleeve because the rubber sleeve is better able to absorb the stresses acting on the same during the printing operation. Thus, an inventively embodied rubber sleeve is considerably less susceptible to both mechanical destruction as well as chemical destruction than rubber sleeves known from practice. As a result, the impact zone embodied between the butting edges of the pre-cut blanket section is more resistant to mechanical and chemical stresses, which ultimately results in a significantly longer service life for the rubber sleeve. However, also in the case of this rubber sleeve, continuous pressure that goes beyond the area of the air gap is not possible.

Preferred developments of the invention are yielded from the following description. Without being limited hereto, exemplary embodiments of the invention are explained in greater detail on the basis of the drawings.

DETAILED DESCRIPTION OF THE DRAWINGS

The prior art will be addressed to begin with, making reference to FIG. 1, before an inventive rubber sleeve is described in the following, making reference to FIG. 2.

Figure 1:
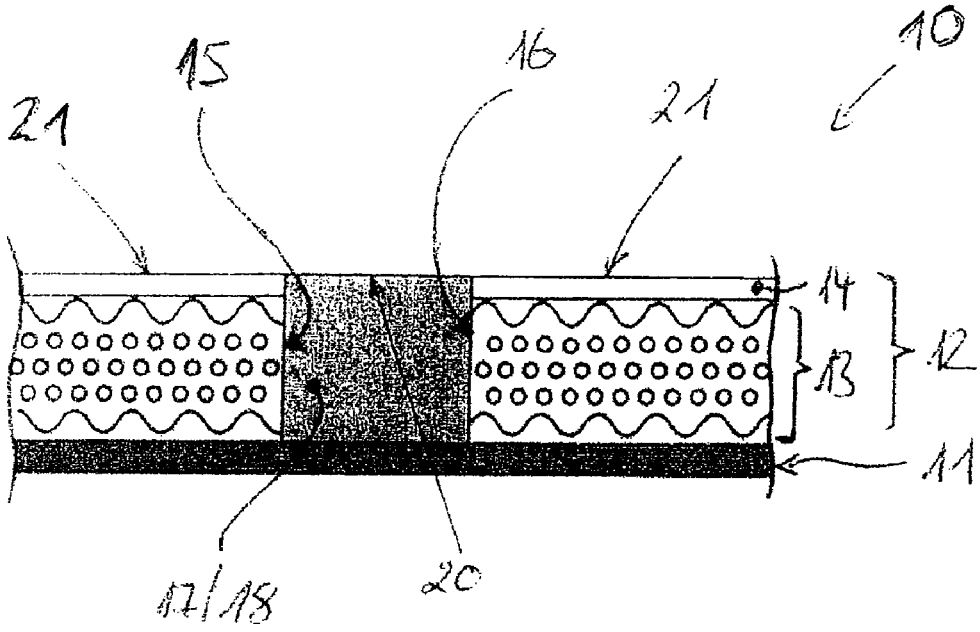
PRIOR ART Fig. 1
FIG. 1 is a cross-section through a rubber sleeve for a printing press known from the prior art.

FIG. 1 shows, in section, a cross-section through a rubber sleeve 10 known from the prior art for non-continuous printing, which includes a rigid support sleeve 11 and a pre-cut part of a blanket 12 wrapped around the support sleeve 11 as well as firmly connected to the support sleeve 11.

The blanket 12 has at least a two-layer structure of a base layer 13 and a functional layer 14 (=printing layer), wherein the functional layer 14 is positioned radially outwardly and is used for the printing process, and wherein the base layer 13 is positioned radially inwardly and is connected to the support sleeve 11.

When the pre-cut part of the blanket 12 is wrapped around the support sleeve 11, opposing butting edges 15, 16 of the blanket 12 form, and a sealing material 18 is introduced in an air gap 17 embodied between the butting edges 15, 16 in order to connect the butting edges 15, 16 with one another.

As a result, according to the prior art, the sealing material 18 is introduced flush with the surface of the blanket 12 in the air gap 17, and a surface 20 of the sealing material 18 consequently terminates flush with a surface 21 of the blanket 12. However, the sealing material 18 is comprised of another material than the functional layer 14 and the base layer 13 and therefore represents, in terms of printing, a malfunction location, over which it is not possible to print continuously and which must be arranged in-register in the printing press, for example with respect to the gap of any printing plates that may possibly be present.

This type of rubber sleeve 10, known from the prior art, is preferably completely finished by grinding, i.e., both in the region of the surface 21 of the blanket 12 as well as in the region of the surface 20 of the sealing material 18, whereby the surface 20 of the sealing material 18 in the case of rubber sleeves known from the prior art is embodied to be open-cell so that media such as printing ink, dampening agent or even washing agent penetrates into the sealing material 18 and is able to destroy the sealing material. In addition, forces in the circumferential direction exert high mechanical stress on the adhesion between the sealing material 18 and the blanket 12. This mechanical and chemical stress reduces the service life of rubber sleeves known from practice.

Figure 2:
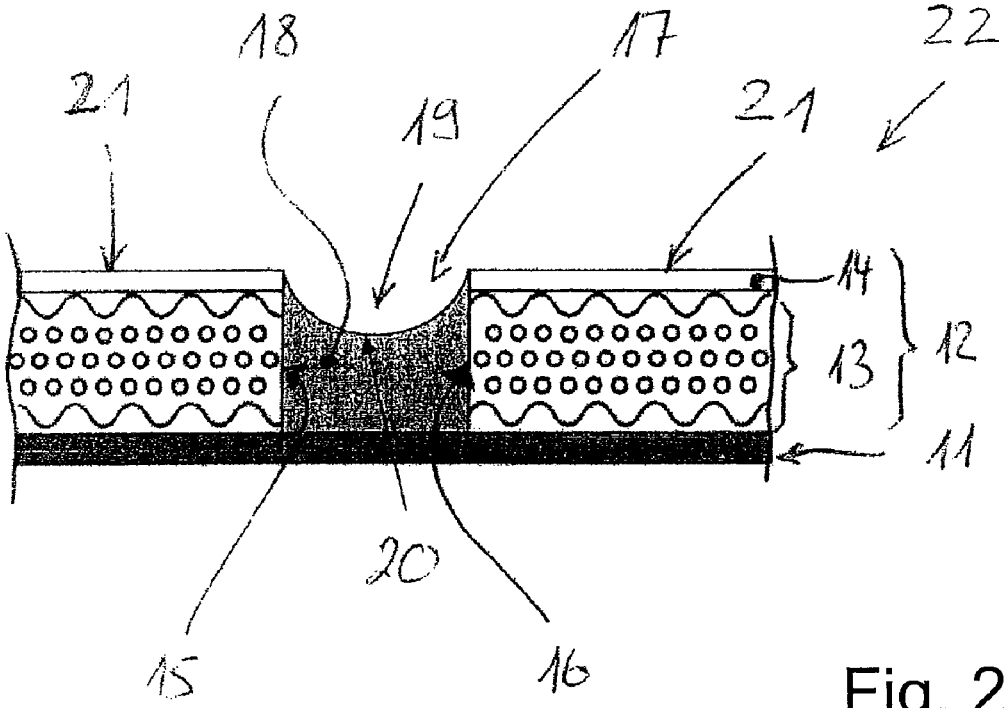
FIG. 2 is a cross-section through an inventive rubber sleeve for a printing press.

FIG. 2 shows, in section, a cross-section through an inventive rubber sleeve 22 for non-continuous printing, wherein to avoid unnecessary repetitions in connection with the inventive rubber sleeve 22 of FIG. 2, the same reference numerals will be used for the same components as was the case in connection with the rubber sleeve 10 in FIG. 1 known from the prior art rubber sleeve 10 and in the following only those details of the invention that differ from the prior art will be discussed in more detail.

As FIG. 2 shows, in the case of the inventive rubber sleeve 22, the sealing material 18 forming a reduced air gap in the form of a channel 19 is introduced in the air gap 17 embodied between the butting edges 15, 16 of the blanket 12. A surface 20 of the sealing material 18 is consequently set back radially inwardly with respect to a surface 21 of the blanket 12 at least in sections, preferably completely. If need be, in the direct connecting region of the sealing material 18 on the butting edges 15, 16, the surface 20 of the sealing material 18 terminates flush with the surface 21 of the blanket 12. However, at least the outer functional layer 14 continues to remain interrupted by an air gap, in the example in FIG. 2, and also a portion of the base layer 13.

The surface 20 of the sealing material 18 is embodied to be smooth and closed-cell at least in sections, in particular completely. This guarantees that no media such as printing ink and/or dampening agent and/or washing agent is able to reach the sealing material 18 and chemically destroy the sealing material. Due to the inventive contouring of the sealing material 18 as a channel 19, forces acting in the circumferential direction have no point of attack so that the mechanical stress of the sealing material 18 in the case of the inventive rubber sleeve 22 is considerably lower than with the rubber sleeve 10 known from the prior art. As a whole, the service life of the inventive rubber sleeve 22 may be increased significantly hereby.

The sealing material 18 is preferably a compressible material.

The procedure for producing the inventive rubber sleeve 22 is as follows: first a rigid support sleeve 11 as well as a pre-cut part of a blanket 12 are made available. The pre-cut part of the blanket 12 is wrapped around the rigid support sleeve 11 and connected to the support sleeve 11. A sealing material 18 in a liquid-like or paste-like state is filled in an air gap 17 between butting edges 15, 16 of the blanket 12, wherein a channel 19 is introduced in the still liquid-like or paste-like sealing material 18. Following this, the sealing material 18 is hardened while retaining the channel 19.

In the case in which a full-surface finishing by grinding of the rubber sleeve 22 takes place, the sealing material 18 is not finished by grinding since its surface 20 is set back relative to the surface 21 of the blanket 12 so that its surface 20 remains smooth and closed-pore.

List of Reference Numbers:

10 Rubber sleeve
11 Support sleeve
12 Blanket
13 Base layer
14 Functional layer
15 Butting edge
16 Butting edge
17 Air gap
18 Sealing material
19 Channel
20 Surface
21 Surface
22 Rubber sleeve The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a rubber sleeve for a printing press, comprising the steps of:

making available a rigid support sleeve;

making available a flat pre-cut part of a blanket;

wrapping the pre-cut part of the blanket around the support sleeve and connecting the pre-cut part to the support sleeve;

filling of a sealing material in a liquid-like or paste-like state in a gap defined between butting edges of the pre-cut part;

forming a channel in the liquid-like or paste-like sealing material; and hardening the sealing material while maintaining the formed channel.

2. The method according to claim 1, wherein a surface of the sealing material in the gap is set back radially inwardly with respect to a surface of the blanket at least in sections.

3. The method according to claim 1, wherein a surface of the sealing material in the gap is completely set back radially inwardly with respect to a surface of the blanket.

4. The method according to claim 1, wherein a surface of the sealing material in the gap is closed-cell at least in sections.

5. The method according to claim 1, wherein a surface of the sealing material in the gap is completely closed-cell.

6. The method according to claim 1, wherein the sealing material is a compressible material.

* * * * *